US008327944B2

(12) United States Patent
King et al.

(10) Patent No.: US 8,327,944 B2
(45) Date of Patent: Dec. 11, 2012

(54) WHIPSTOCK ATTACHMENT TO A FIXED CUTTER DRILLING OR MILLING BIT

(75) Inventors: William W. King, Houston, TX (US); Michael R. Reese, Houston, TX (US); Steven W. Drews, Cypress, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 191 days.

(21) Appl. No.: 12/789,416

(22) Filed: May 27, 2010

(65) Prior Publication Data

US 2010/0319997 A1 Dec. 23, 2010

Related U.S. Application Data

(60) Provisional application No. 61/182,442, filed on May 29, 2009.

(51) Int. Cl.
*E21B 7/08* (2006.01)

(52) U.S. Cl. ..... 166/378; 166/117.5; 175/75

(58) Field of Classification Search ..... 175/75; 166/117.5, 117.6, 378
See application file for complete search history.

(56) References Cited

U.S. PATENT DOCUMENTS

| | | | | |
|---|---|---|---|---|
| 1,970,761 A | * | 8/1934 | McVicar | 175/82 |
| 2,136,748 A | * | 11/1938 | Lottinger | 175/45 |
| 2,196,528 A | | 4/1940 | Hughes | |
| 2,207,920 A | | 7/1940 | Hughes | |
| 2,215,913 A | | 9/1940 | Brown | |
| 2,331,293 A | * | 10/1943 | Ballard | 166/117.5 |
| 2,334,746 A | | 11/1943 | Brantly | |
| 2,357,330 A | * | 9/1944 | Hyer | 166/117.5 |
| 2,492,794 A | | 12/1949 | Goble et al. | |
| 2,493,178 A | | 1/1950 | Williams, Jr. | |
| 2,495,439 A | * | 1/1950 | Brimble | 175/81 |
| 2,642,267 A | * | 6/1953 | Zublin | 175/75 |
| 2,658,284 A | * | 11/1953 | Jacob | 33/312 |
| 2,669,429 A | * | 2/1954 | Zublin | 175/74 |
| 2,708,105 A | | 5/1955 | Williams, Jr. | |
| 2,869,825 A | | 1/1959 | Crawford | |
| 3,266,577 A | | 8/1966 | Turner | |

(Continued)

FOREIGN PATENT DOCUMENTS

EP 0418706 A1 3/1991

(Continued)

OTHER PUBLICATIONS

Sinor, Allen: "Casing Drilling—Recent Advances for Drilling Challenges," Hughes Christensen—A Baker Hughes Company, The Woodlands, TX, SPE Gulf Coast Section Jan. 10, 2001 (34 pages).

(Continued)

*Primary Examiner* — Nicole Coy
(74) *Attorney, Agent, or Firm* — Gardere Wynne Sewell LLP; Andre M. Szuwalski

(57) ABSTRACT

An assembly is provided to attach a whipstock to a mill/drill bit. The assembly includes an upper collar adapted for installation around a shank of the mill/drill bit. At least one connecting member is mounted at a first end to the upper collar. The connecting member extends downwardly from the upper collar and is adapted to fit within a junkslot of the mill/drill bit to which the upper collar is attached. A whipstock attachment structure is mounted to a second end of the at least one connecting member.

30 Claims, 9 Drawing Sheets

U.S. PATENT DOCUMENTS

| | | | | |
|---|---|---|---|---|
| 4,101,318 | A | | 7/1978 | Rudy |
| 4,351,401 | A | | 9/1982 | Fielder |
| 4,605,343 | A | | 8/1986 | Hibbs, Jr. et al. |
| 4,696,354 | A | | 9/1987 | King et al. |
| 4,714,120 | A | | 12/1987 | King |
| 4,794,986 | A | | 1/1989 | Langer |
| 4,815,342 | A | | 3/1989 | Brett et al. |
| 4,823,892 | A | | 4/1989 | Fuller |
| 4,889,017 | A | | 12/1989 | Fuller et al. |
| 4,956,238 | A | | 9/1990 | Griffin |
| 5,042,596 | A | | 8/1991 | Brett et al. |
| 5,090,492 | A | | 2/1992 | Keith |
| 5,127,923 | A | | 7/1992 | Bunting et al. |
| 5,244,039 | A | | 9/1993 | Newton, Jr. et al. |
| 5,259,469 | A | | 11/1993 | Stjernstrom et al. |
| 5,330,016 | A | | 7/1994 | Paske et al. |
| 5,346,025 | A | | 9/1994 | Keith et al. |
| 5,441,121 | A | | 8/1995 | Tibbitts |
| 5,549,171 | A | | 8/1996 | Mensa-Wilmot et al. |
| 5,551,522 | A | | 9/1996 | Keith et al. |
| 5,582,261 | A | | 12/1996 | Keith et al. |
| 5,651,421 | A | | 7/1997 | Newton et al. |
| 5,797,455 | A | | 8/1998 | Barron et al. |
| 5,826,651 | A | | 10/1998 | Lee et al. |
| 5,887,668 | A | | 3/1999 | Haugen et al. |
| 5,979,571 | A | * | 11/1999 | Scott et al. ..... 175/61 |
| 6,039,127 | A | | 3/2000 | Myers |
| 6,062,326 | A | | 5/2000 | Strong et al. |
| 6,063,502 | A | | 5/2000 | Sue et al. |
| 6,138,756 | A | | 10/2000 | Dale |
| 6,298,930 | B1 | | 10/2001 | Sinor et al. |
| 6,401,820 | B1 | | 6/2002 | Kirk et al. |
| 6,439,326 | B1 | | 8/2002 | Huang et al. |
| 6,443,247 | B1 | | 9/2002 | Wardley |
| 6,460,631 | B2 | | 10/2002 | Dykstra et al. |
| 6,464,002 | B1 | * | 10/2002 | Hart et al. ..... 166/117.6 |
| 6,510,906 | B1 | | 1/2003 | Richert et al. |
| 6,612,383 | B2 | | 9/2003 | Desai et al. |
| 6,612,384 | B1 | | 9/2003 | Singh et al. |
| 6,620,308 | B2 | | 9/2003 | Gilbert |
| 6,655,481 | B2 | | 12/2003 | Findley et al. |
| 6,659,173 | B2 | | 12/2003 | Kirk et al. |
| 6,702,045 | B1 | | 3/2004 | Elsby |
| 6,725,939 | B2 | | 4/2004 | Richard |
| 6,817,633 | B2 | | 11/2004 | Brill et al. |
| 6,845,816 | B2 | | 1/2005 | Kirk et al. |
| 6,848,517 | B2 | | 2/2005 | Wardley |
| 7,066,253 | B2 | | 6/2006 | Baker |
| 7,096,982 | B2 | | 8/2006 | McKay et al. |
| 7,117,960 | B2 | | 10/2006 | Wheeler et al. |
| 7,216,727 | B2 | | 5/2007 | Wardley |
| 7,322,776 | B2 | | 1/2008 | Webb et al. |
| 7,395,882 | B2 | | 7/2008 | Oldham et al. |
| 2002/0170713 | A1 | | 11/2002 | Haugen et al. |
| 2004/0108739 | A1 | | 6/2004 | Beeman et al. |
| 2004/0188141 | A1 | | 9/2004 | Slaughter et al. |
| 2004/0226751 | A1 | | 11/2004 | McKay et al. |
| 2004/0244540 | A1 | | 12/2004 | Oldham et al. |
| 2004/0245020 | A1 | | 12/2004 | Giroux et al. |
| 2005/0103530 | A1 | | 5/2005 | Wheeler et al. |
| 2005/0145417 | A1 | | 7/2005 | Radford et al. |
| 2006/0070771 | A1 | | 4/2006 | McClain et al. |
| 2006/0124706 | A1 | | 6/2006 | Raybould et al. |
| 2007/0175671 | A1 | | 8/2007 | Nava |
| 2007/0193782 | A1 | | 8/2007 | Fang et al. |
| 2007/0246224 | A1 | | 10/2007 | Krauss et al. |
| 2007/0261890 | A1 | | 11/2007 | Cisneros |
| 2007/0289782 | A1 | | 12/2007 | Clark et al. |
| 2008/0149398 | A1 | | 6/2008 | Azar |
| 2008/0187403 | A1 | | 8/2008 | Ertl et al. |
| 2009/0078470 | A1 | | 3/2009 | Lyons et al. |
| 2009/0120693 | A1 | | 5/2009 | McClain et al. |
| 2010/0051349 | A1 | | 3/2010 | Ballard et al. |
| 2010/0282519 | A1 | | 11/2010 | Zhang et al. |

FOREIGN PATENT DOCUMENTS

| | | | |
|---|---|---|---|
| GB | 1153988 | A | 6/1969 |

OTHER PUBLICATIONS

Office Action mailed Oct. 13, 2006 for U.S. Appl. No. 10/783,720 (27 pages).

Office Action mailed Apr. 20, 2006 for U.S. Appl. No. 10/783,720 (32 pages).

Tarr, Brian, et al.: "Casing-while-Drilling: The Next Step Change in Well Construction," Published in World Oil, Oct. 1999 issue (10 pages).

Sinor, L.A., et al.: "Rotary Liner Drilling for Depleted Reservoirs," IADC/SPE 39399, Mar. 3-6, 1998 (10 pages).

Galloway G.: "Rotary Drilling with Casing—A field proven method of reducing wellbore construction cost," World Oil Casing Drilling Technical Conference, Mar. 6-7, 2003 (7 pages).

McKay, D., et al.: "New Developments in the Technology of Drilling with Casing: Utilizing a Displaceable DrillShoe Tool," World Oil Casing Drilling Technical Conference, Mar. 6-7, 2003 (11 pages).

PCT International Preliminary Report on Patentability and Written Opinion mailed Dec. 8, 2011 for PCT/US2010/036668 (9 pages).

Hughes Christensen, "Reduce Risk, Ensure your casing gets to total depth", EZReam, Baker Hughes Inc, 2007 (4 pages).

"DrillShoe III, Drilling with Casing", Weatherford International Ltd., 2005-2008 (4 pages).

"DrillShoe II, 5-Blade Models, Drilling with Casing", Weatherford International Ltd., 2008 (4 pages).

"DrillShoe II, 4-Blade Models, Drilling with Casing", Weatherford International Ltd., 2005-2007 (4 pages).

PCT International Search Report and Written Opinion cited in Application No. PCT/US2010/036668, dated Jul. 30, 2010 (10 pages).

* cited by examiner

WHIPSTOCK ATTACHMENT TO A FIXED CUTTER DRILLING OR MILLING BIT

PRIORITY CLAIM

This application claims priority from U.S. Provisional Patent Application No. 61/182,442 filed May 29, 2009, the disclosure of which is incorporated by reference.

CROSS REFERENCE TO RELATED APPLICATIONS

This application is related to U.S. Provisional Patent Application Nos. 61/184,635 filed Jun. 5, 2009 (now U.S. application Ser. No. 12/793,489, filed Jun. 3, 2010) and 61/182,382 filed May 29, 2009 (now U.S. application Ser. No. 12/787,349, filed May 25, 2010), the disclosures of which are incorporated by reference.

TECHNICAL FIELD

The present invention relates generally to milling and drilling methods and tools, and more particularly to the attachment of whipstocks to milling or drilling bits used in milling and drilling operations.

BACKGROUND

Milling tools are known for use in removing a section or window of existing casing from a well bore. In a known implementation, a whipstock-mill combination tool is run into the wellbore. This combination tool typically comprises a milling bit which is secured to a top of the whipstock. The milling bit is in some instances a starting mill. At a desired wellbore depth, typically set with a packer, the whipstock (which is hanging from the milling bit) is set at a correct orientation and secured in place. The milling bit is then freed from the whipstock and rotated with applied pressure. The concave face and taper of the whipstock forces the milling bit against the inside of the casing to cut an initial casing window (this initial milling operation may also remove the mechanism which attached the top of the whipstock to the milling bit). The starting mill is then removed from the wellbore and a window mill bit, attached to a more flexible drill string, is lowered into the wellbore. This window mill bit is then rotated to mill down from the initial casing window as the window mill bit rides further down the concave face and taper of the whipstock. This forms a casing window opening. The window mill bit is then removed. Additional mill bits may be run in the wellbore to define the size and shape of the opening in the casing. To the extent additional formation drilling is desired after opening the casing window, for example in connection with directional drilling operations, a drill bit would then be run into the wellbore and out through the formed casing window to engage the formation.

It will be recognized by those skilled in the art that the operation for milling a casing window is quite time consuming and expensive since it requires several different tools and multiple trips down the wellbore. If further formation drilling is required after opening the casing window, yet another trip is needed to run the formation drilling equipment back into the wellbore. There would be an advantage if more efficient milling and drilling methods and tools were available for use in connection with the milling of a casing window and the drilling of formations through that casing window.

In connection with known one trip mill-drill systems, which utilize a whipstock hung under the mill or mill drill for whipstock run in, orientation, and placement, the typical method for attaching the whipstock to the mill or mill drill utilizes one or more threaded sockets or a threaded nozzle port in the lower portion of the bit. An intervening component is then bolted to the threaded socket(s) and to the upper portion of the whipstock assembly. Operation of the system involves shearing off the bolted connection with the application of weight and rotational force. This weight and rotational force, through the concave face and taper of the whipstock, further urges the mill drill into the casing wall so as to commence window milling.

For efficiency and trip savings reasons, tool designers try to design the mill drill to be capable of both milling out the casing window and effectively drilling ahead into and through the rock formations beyond the casing. This design goal has not generally been satisfactorily achieved. One reason for this is that the diamond layers of PDC drill bit cutters which tool designers prefer for use in effectively removing formation material are not as effective for use in milling steel casing material. It is known that other materials, such as tungsten carbide, or cubic boron nitride (CBN), are better at cutting ferrous materials, like well casings, but are not as effective at cutting rock that is encountered for instance after the casing has been penetrated. To address this issue, it is known in the art to provide PDC drill bits with tungsten carbide, or cubic boron nitride (CBN), cutting features to assist in milling operations, while the PDC cutters of the bit function in connection with subsequent formation drilling. The performance of these combination mill/drill bits has not been entirely satisfactory.

An issue also arises with respect to connecting the whipstock to a PDC drill bit. Most PDC drill bits used in oilfield applications today are manufactured with bodies cast from a tungsten carbide matrix. It is extremely difficult and time consuming to attempt to retrofit a matrix PDC bit design with a threaded socket for whipstock attachment because the matrix material is too hard for standard machining. Alternatively, the threaded socket can be included in the original casting design. However, the design and integrity of the bit can be compromised by the inclusion of the threaded socket (either machined in, or cast in). These problems exist as well for bits whose bit bodies are made from material other than tungsten carbide. The incorporation of threaded sockets for whipstock attachment in steel bit bodies, for example, may also compromise optimum design or bit body integrity.

There accordingly exists a need in the art for an attachment mechanism for hanging a whipstock from a drag-type PDC drill bit. Preferably, a non-invasive way of attaching a whipstock to a standard drag-type PDC drill bit would be provided. This solution could also be applied to application specific mills or mill drills so as to eliminate the necessity for an invasive threaded socket to attach the whipstock.

Reference is made to prior art U.S. Pat. Nos. 7,178,609, 5,887,655, 3,652,138 and 5,069,297, the disclosures of which are hereby incorporated by reference in their entirety. Reference is also made to the Knight Fishing Services, X-1 Single Trip Whipstock; the Smith Services Trackmaster Plus Wellbore Departure System, the Weatherford Quickcut Casing Exit System, and the Western Well Tool Non-Rotating Protectors, prior art devices (incorporated by reference).

SUMMARY

A non-invasive assembly for attaching a whipstock to a mill/drill bit uses a collar which is placed around the shank of the mill/drill bit. The mill/drill bit may comprise a PDC drill bit which is configured for both milling and drilling functional operation. The collar serves as a platform for an attachment apparatus connecting to a whipstock.

In one embodiment the assembly comprises: an upper collar assembly including a channel (or slot); one or more connecting members secured on the channel; a lower ring assembly incorporating a lower ring flange; and a whipstock attachment mechanism passing through the flange. The upper collar assembly is hinged on one side and includes a latching mechanism on another side. The upper collar is constructed, when latched closed, to firmly grip a bit shank and its breaker slot flats.

In a preferred embodiment the upper collar also incorporates integral breaker slot inserts that fill the breaker slots on both sides of the bit shank when the upper collar is latched closed. An advantage of using the breaker slots as a clamping and locating area is that they are held to a tolerance to mate with standard bit breakers. Another advantage is that after the drill bit is made up to the string the bit breaker slots are not utilized again until the bit is ready to be removed from the string. Yet another advantage is that the bit breaker area is made of tough, high strength steel and can support the weight of the whipstock assembly transmitted through the attachment connecting members of the invention.

Although the advantages of using the breaker slot as a location for locating the upper collar have been described the invention is not limited to using the breaker slot. The upper collar can be deployed on the shank surface at any point between the top of the gage pads and the mud seal of the API connection. Alternatively the upper collar can be configured to clamp on all, or a portion of, the breaker slot area and additionally clamp on part of the full cylindrical shank section above and/or below the breaker slot area. If the bit does not have breaker slots built into the shank then the upper collar may be clamped solely to a cylindrical portion of the shank.

The upper collar incorporates a positive attachment method that allows for one or more connecting members to be attached to the collar. The connecting member(s) are attached at a circumferential location that coincides with the top of one of the channels that is formed between the blades of the bit. These channels are commonly referred to as junk slots. If the bit gage sections at the boundary of the junk slot(s) are vertical, then the mating connecting member is oriented vertically. If the gage sections at the boundary of the junk slot(s) are angled, then the mating connecting member(s) are angled to match the angle of the gage sections. In an embodiment, the angle of the connecting member is locked in place to match the angle (or vertical orientation) of the corresponding junk slot(s).

The connecting member(s) have a length that extends a short distance beyond the face of the bit. The connecting members include a positive attachment method that allows them to be firmly connected to the lower ring assembly. The lower ring assembly may or may not be a full ring. If, for instance, only one connecting member is used then the lower ring assembly will only be a short arc that is sufficiently sized to include the positive attachment means to the connecting member, and to carry the lower ring bolt flange.

Some of the materials that can be used to construct the main components of the assembly include steel, cast iron, aluminum, titanium, copper, other applicable metals and alloys, phenolic, composites, rubber, or combinations of the above. Any of the components can be designed to shear apart under given loads. The outer circumference of the upper collar assembly need not be circular. In the instance where only one or two connecting members will be used the upper collar may have lobes specific for mounting to the upper ends of the connecting member(s). The rest of the upper collar may be of a lesser cross section than these lobed areas.

The latching method for the upper collar can be one of many known in the art, including: bolts, catches, pins, or cam-locks (it being understood that this is not an exhaustive list).

To further stiffen the assembly, an additional (but optional) mid-ring may be deployed below the upper collar but above the upper gage bevel of the bit, and this ring can be used to further interconnect the connecting members. The mid-ring can also be used to tighten a single connecting member against the inner surface of the junk slot so as to limit any tendency of the connecting member to bend away from the bit or to twist.

Alternatively a tie down strap may be used to pull on the lower inner surface of the lower ring or connecting member. The tie down strap is drawn across the center of the bit face, run up a generally opposing junk slot and tied or fastened into the opposite side of the upper collar. The tie down strap may be made of braided copper or steel wire, or any other material that can supply the appropriate amount of tension to hold the lower ring and connecting member tightly in place.

The connecting member(s) may be shaped to approximate the cross-sectional shape of the junk slot they are deployed through. The connecting members have a length that is sized to extend from the attachment area on the upper collar to a point proximate to or below the outer bit face.

In a preferred embodiment, a single attachment point on the upper collar is attached to a single connecting member that carries an attachment means at the lower end of the connecting member for attachment to an upwardly deployed attachment means from the top of a whipstock. In this embodiment, the preferred shear bolt or other shear component is located at or near the attachment point on the upper collar. After setting the whipstock, the application of downward force in the form of weight, or upward force in the form of pull, causes the shear member to break. This allows the drill bit and/or mill drill to be released from the whipstock. In this embodiment, the mill drill can then be retracted a few feet prior to beginning its milling run in order to immediately mill up the connecting member prior to commencing the rest of the milling task. Rotation of the bit may then commence to effectuate milling operations. Initial milling operations will destroy the connecting member and any remaining part of the shear component.

In one specialized embodiment of the apparatus an additional lobe is provided on the upper collar that can be used to deploy sensors capable of communicating information to the lower housing of a mud motor, or capable of recording downhole information.

In another specialized embodiment of the apparatus, an additional lobe is provided to operate an internal unlatching mechanism to unlatch the upper end of a connecting member after the whipstock has been set. An option in this embodiment is to remotely activate the unlatching mechanism through the use of a signal sent from surface via wired drill pipe or a combination of wired bottom hole assembly components and mud pulse signaling. In this embodiment, the mill drill can then be retracted a few feet prior to beginning its milling run in order to immediately mill up the connecting member prior to commencing the rest of the milling task.

The assembly is advantageously used in connection with hanging a whipstock from a drill bit. That drill bit is preferably a PDC drill bit which is configured to support both milling and drilling operations. Thus, the bit functions initially to mill a window in the casing, and thereafter functions to drill the formation outside of the casing window. This is accomplished by configuring the drill bit cutters for milling of the casing and subsequently for drilling earth formations. In a preferred implementation, the cutters used on the PDC drill bit include a cap (such as a tungsten carbide cap, a tungsten carbide or CBN tipped cap, or a similar fitted cap) made of a suitable material that can be fitted as an integral part of the existing PDC cutting structure. The cap is mounted to a PDC cutter which comprises a diamond face and underlying tungsten carbide substrate. The cap may cover, without directly bonding to, at least some portion of the diamond face of the PDC cutter.

The cap on the PDC cutter is used to effectuate milling of the casing window. When the bit moves into the formation outside of the casing window, the cap is destroyed by interaction with the formation to expose the underlying PDC diamond table. The diamond table of the PDC cutter is then used to effectuate drilling of the formation.

DETAILED DESCRIPTION OF THE DRAWINGS

Figure 1:
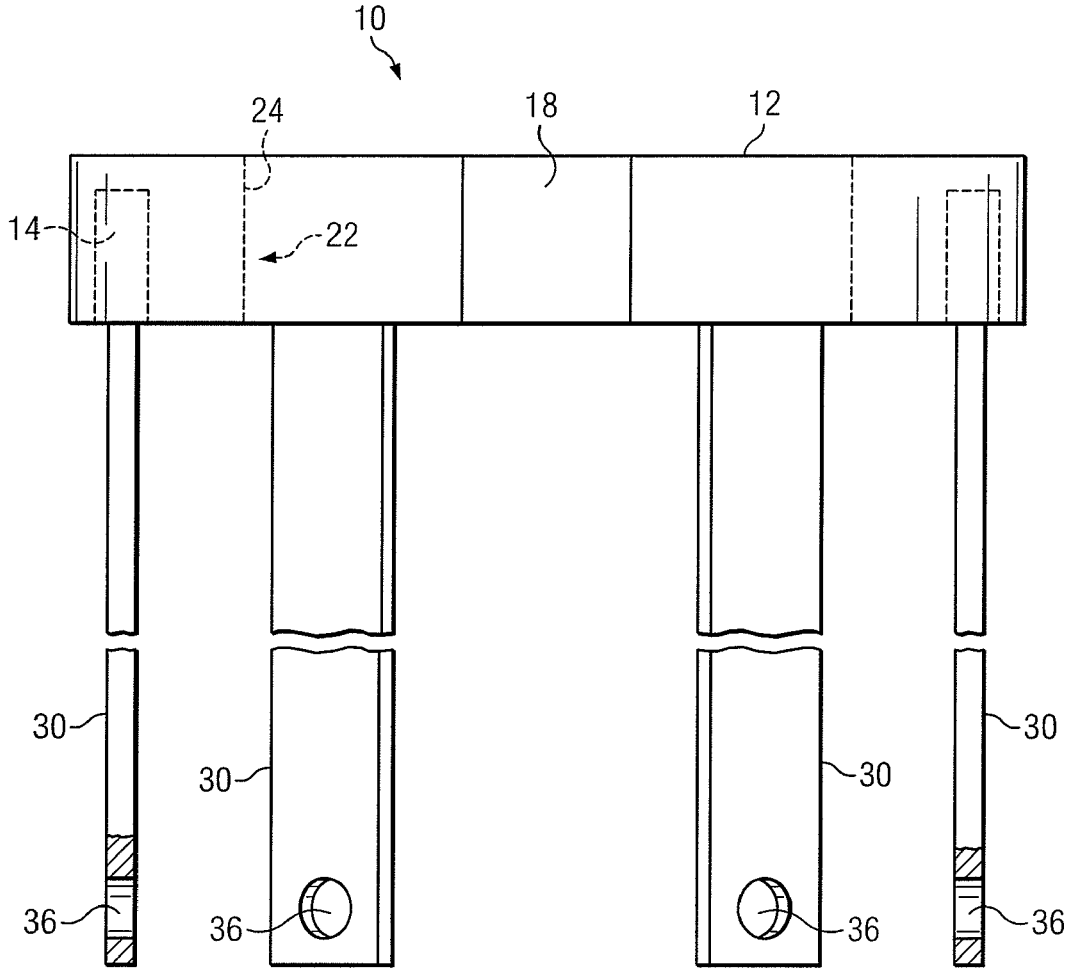
FIGS. 1 and 2 are a side view and top view, respectively, of a non-invasive assembly for attaching a whipstock to a mill/drill bit.

Reference is now made to FIG. 1 which shows a side view of a non-invasive assembly 10 for attaching a whipstock to a mill/drill bit. A top view of the assembly 10 is provided in FIG. 2. The assembly 10 of FIGS. 1 and 2 comprises an upper collar 12. The upper collar 12 is formed of a generally circular shape which includes a channel (or slot) 14 that is formed in and opens from the underside of the upper collar. The upper collar circular shape is formed from two arcuate (for example, semicircular) members 16 that are hinged together at one point and which are capable of being latched together at an opposite point. A latching mechanism 18 is provided to detachably connect the two arcuate members 16 of the upper collar 12. The hinge 20 allows for the unlatched ends of the two arcuate members 16 to be separated from each other when the collar 12 is unlatched. The latching method for the upper collar 12 can be one of many known in the art, including: bolts, catches, pins, or cam-locks (wherein this is not an exhaustive list). It will be recognized that the outer circumference of the upper collar assembly 10 need not be circular in all implementations. The inner surface of the collar 12 preferably conforms in size and shape to the shank portion of a bit to which the collar is to be installed.

Each arcuate member 16 may include an integral breaker slot insert 22 positioned across an inside surface of the arcuate member 16. The breaker slot insert 22 has an inside flat surface 24 and an outside curved surface 26 which conforms to an inside surface of the arcuate member 16. When the two arcuate members 16 are latched together, the inside flat surfaces 24 of the integral breaker slot inserts 22 are parallel to each other. As discussed above, the inner surface of the collar preferably conforms in size and shape to the shank portion of a bit to which the collar is to be installed. The integral breaker slot inserts 22, if included, accordingly conform to the size and shape of the breaker slots on the bit shank.

Connected to the upper collar 12, and extending downwardly therefrom, the assembly 10 further includes at least one connecting member 30. Reference is now additionally made to FIG. 3 which shows front and side views of a connecting member 30. A first end 32 of each included connecting member is secured within the channel 14 formed in the upper collar 12. A second, opposite, end 34 of each included connecting member 30 includes an attachment opening 36 (a lower ring attachment hole). A positive attachment mechanism 38, such as a cam, is provided to attach the first end 32 of the one or more connecting members 30 within the channel 14 of the collar 12. When multiple connecting members 30 are attached to a collar 12, those members are preferably, but not necessarily, circumferentially spaced about the upper collar.

FIG. 1 illustrates that the connecting members 30 are connected to the upper collar 12 in a manner such that each connecting member is oriented perpendicular to the upper collar. In an alternative embodiment, the connecting members 30 are connected to the upper collar 12 in a manner such that the orientation of each connecting member is not perpendicular to the upper collar. See, FIG. 4 and discussion herein.

Figure 4:
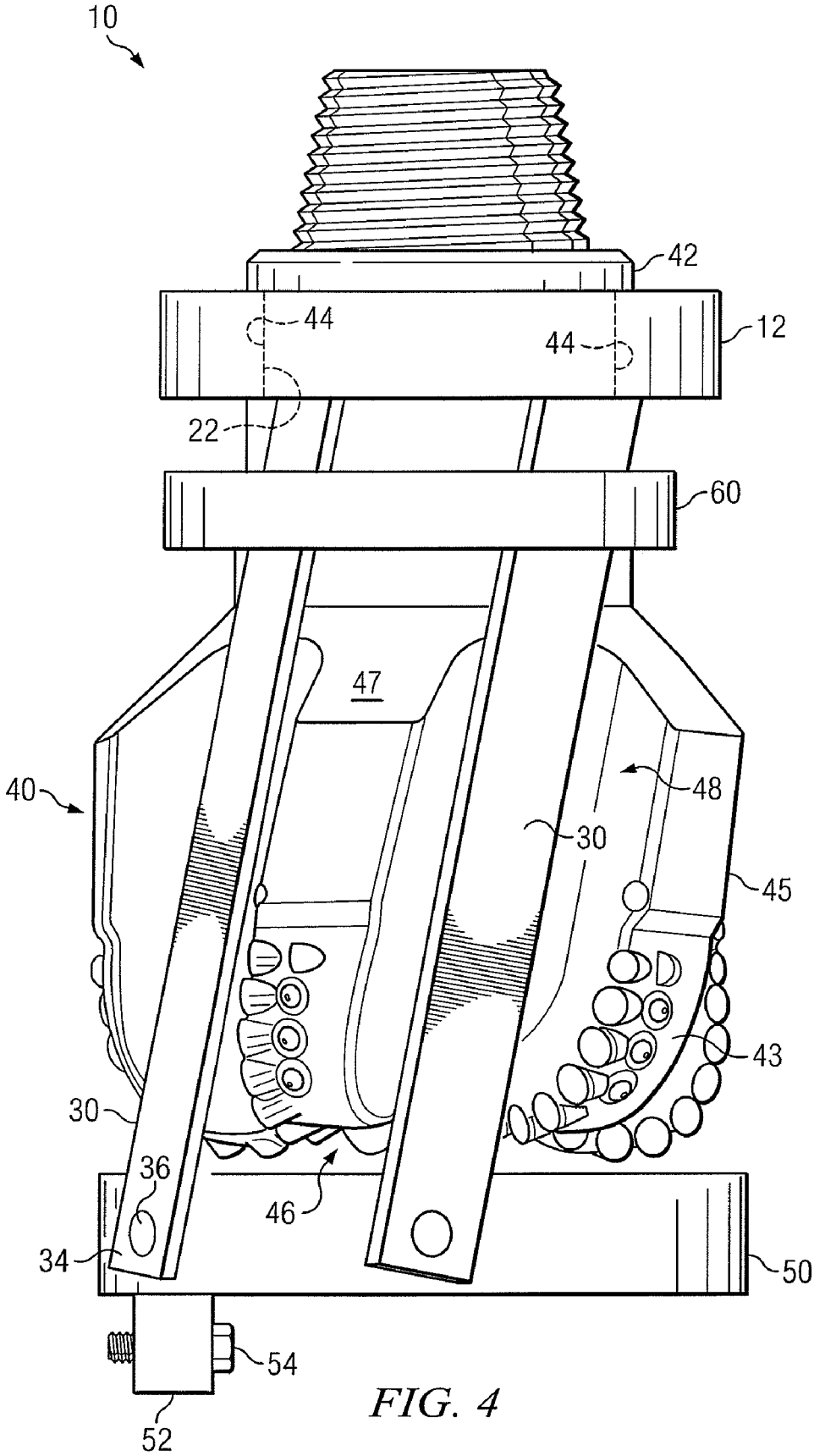
FIG. 4 shows a view of the assembly mounted to a mill/drill bit.

FIG. 4 shows the assembly 10 as mounted to a mill and/or drill bit 40. FIG. 4 specifically shows mounting of the assembly 10 to a drag-type PDC drill bit as an example only. The mill/drill bit 40 may comprise a PDC drill bit which is configured for both milling and drilling functional operation as discussed herein. It will be understood that the assembly could be configured in size and shape for mounting to any desired type of bit.

Figure 2:
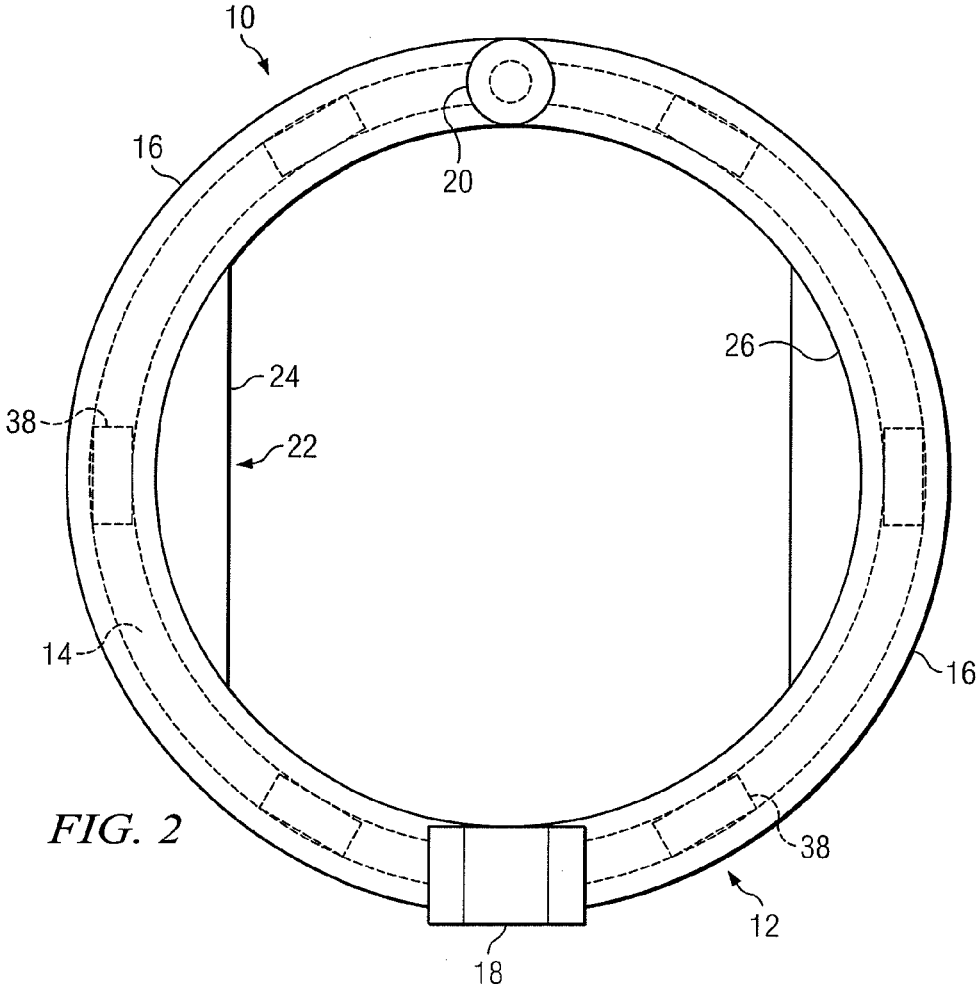
Figure 3A:
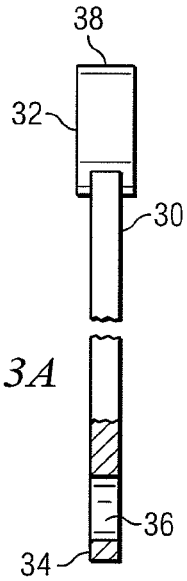
FIG. 3 show side and front views of a connecting member for the assembly.
Figure 3B:
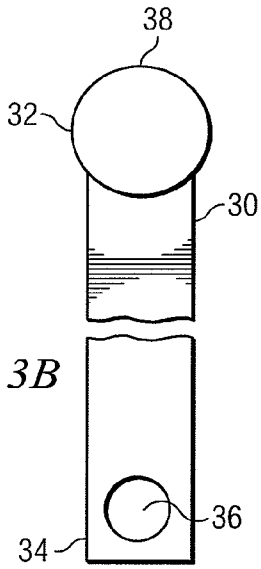
Figure 4A:
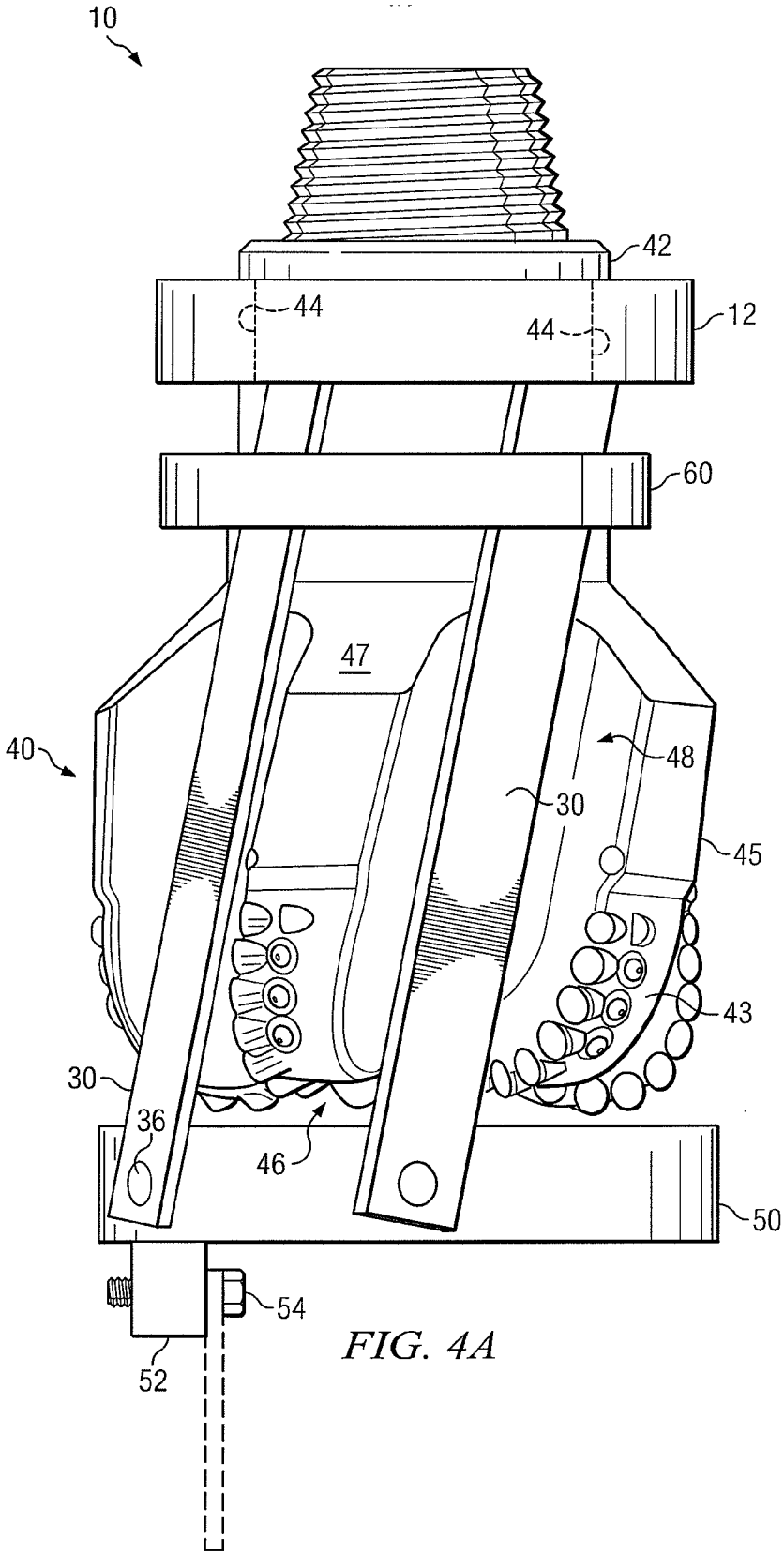
FIG. 4A shows the attachment of a whipstock to the assembly and drill bit.

FIG. 4 further shows additional components of the assembly 10 which are not shown in FIGS. 1-3. The additional components of the assembly 10 include a lower ring 50 which is mounted, through the lower ring attachment holes 36 (see, FIG. 3) to the second end 34 of each included connecting member. The lower ring 50 assembly incorporates a lower ring bolt flange 52. A whipstock attachment bolt 54 is provided with respect to the lower ring bolt flange. FIG. 4A shows the attachment of a whipstock to the assembly 10 using the flange 52 and bolt 54. Details for the configuration of the whipstock are not illustrated, it being recognized that generally speaking any whipstock could be attached to the assembly 10 and the configurations of whipstocks are well known to those skilled in the art.

To install the assembly 10 on a mill/drill bit 40, the latch 18 on the upper collar 12 is opened and the two arcuate members 16 are spread using the hinge 20. The upper collar 12 is then positioned around the shank 42 of the mill/drill bit 40 and the latch 18 is closed. The integral breaker slot inserts 22 are positioned, when the collar 12 is latched closed, to fill the breaker slots 44 which are included on both sides of the shank 42. The upper collar 12 is constructed to firmly grip the shank 42 and breaker slot 44 flats. The breaker slot inserts 22 of the upper collar 12 accordingly function in the manner of a clamp to secure the position of the upper collar and preclude the collar from rotating about the shank 42. The collar 12 accordingly serves as a platform for attaching the assembly 10 to the bit 40 and supporting the hanging of a whipstock from the bit.

An advantage of using the breaker slots 44 as a clamping and locating area is that they are held to a tolerance to mate with standard bit breakers. Another advantage is that after the drill bit 40 is made up to the string the bit breaker slots 44 are not utilized again until the bit is ready to be removed from the string. Yet another advantage is that the bit breaker area is made of tough, high strength steel and can support the weight of the whipstock assembly transmitted through the attachment connecting members 30 of the assembly 10.

Although there are advantages to using the breaker slot 44 as a location aid for fixing the rotational orientation of the upper collar 12, there are alternatives to using the breaker slot. The upper collar 12 can be deployed on the shank 42 surface at any point between the top of the gage pads and the mud seal of the API connection. Alternatively the upper collar 12 can be configured to clamp on all, or a portion of, the breaker slot 44 area and additionally clamp on part of the full cylindrical shank 42 section above and/or below the breaker slot area. If the bit does not have breaker slots 44 built into the shank 42 then the upper collar 12 may be clamped solely to a cylindrical portion of the shank.

Each connecting member 30 has a length that extends a short distance beyond the face 46 of the bit. For example, the connecting member 30 length may be sized to extend from the attachment area on the upper collar 12 to a point proximate to or below the outer bit face 46. The positive attachment provided for each connecting members 30 in the channel 14 firmly attaches the connecting member to the upper collar 12. A positive attachment is further provided, through the lower ring attachment hole 36, between each connecting member and the lower ring 50 assembly.

Each included connecting member 30 is attached at a circumferential location on the collar 12 that coincides, when the collar is secured to the bit shank 42, with the top of one of the channels 48 formed between the blades 43 of the bit. These channels 48 are commonly referred to as junk slots. If the bit gage 45 sections at the boundary of the junk slot(s) 48 are vertical, then the mating connecting member 30 is oriented vertically (as shown in FIG. 3). If the gage 45 sections at the boundary of the junk slot(s) 48 are angled, then the mating connecting member(s) 30 are angled to match the angle of the gage sections (as shown in FIG. 4). In an embodiment, the angle of each connecting member 30 is locked in place to match the angle (or vertical orientation) of its corresponding junk slot 48. The connecting member 30 may be shaped to approximate the cross-sectional shape of the junk slot 48 in which the member is to be deployed.

To further stiffen the assembly 10, an additional (but optional) mid-ring 60 may be deployed below the upper collar 12 but above the upper gage 45 bevel of the bit, and can be used to further interconnect the connecting members 30. The mid-ring 60 can also be used to tighten a single connecting member 30 against the inner surface of the junk slot 48 to limit any tendency of the connecting member to bend away from the bit 40 or to twist. The mid-ring 60 is accordingly connected to each included connecting member 30 and is positioned at a convenient location between the two opposed ends 32 and 34 of the connecting members. That location for mid ring 60 placement may be driven by the relationship between the bit shank 42 and the bit body 47.

The lower ring 50 assembly, although illustrated in FIG. 4 as a full ring, need not have a full ring configuration. If, for instance, only one connecting member 30 is used then the lower ring 50 assembly need only be a short arc that is sufficiently sized to include the positive attachment to the connecting member and carry the lower ring bolt flange 52. See, for example, FIG. 6. The use of a lower ring may not be required at all, in which case the flange 52 is attached to the lower end of the connecting member 30.

Some of the materials that can be used to construct the main components of the assembly 10 include steel, cast iron, aluminum, titanium, copper, other applicable metals and alloys, phenolic, composites, rubber, or combinations of the above. Any of the components can be designed to shear apart under given loads.

Figure 5:
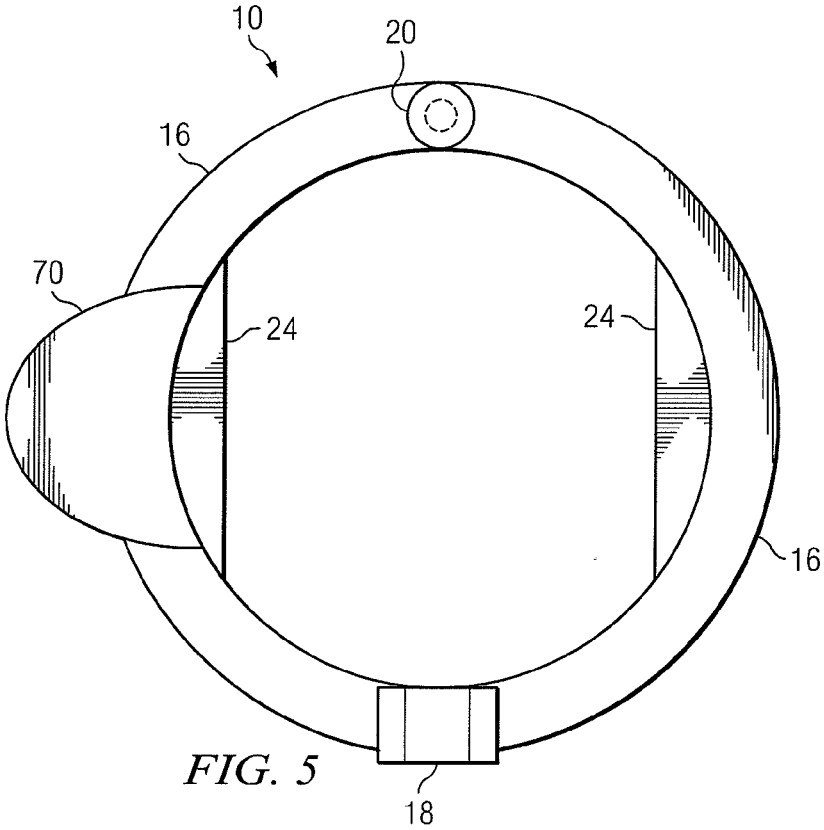
FIGS. 5 and 6 show a top view and side view, respectively, of an alternative embodiment of the assembly.

Reference is now made to FIG. 5 which shows a top view of an alternative embodiment of the assembly 10. In the instance where only one or two connecting members 30 will be used the upper collar 12 may include a corresponding lobe 70 specific for mounting to the upper end of the connecting member. The rest of the upper collar may be of a lesser cross section than in any included lobed area.

Figure 6:
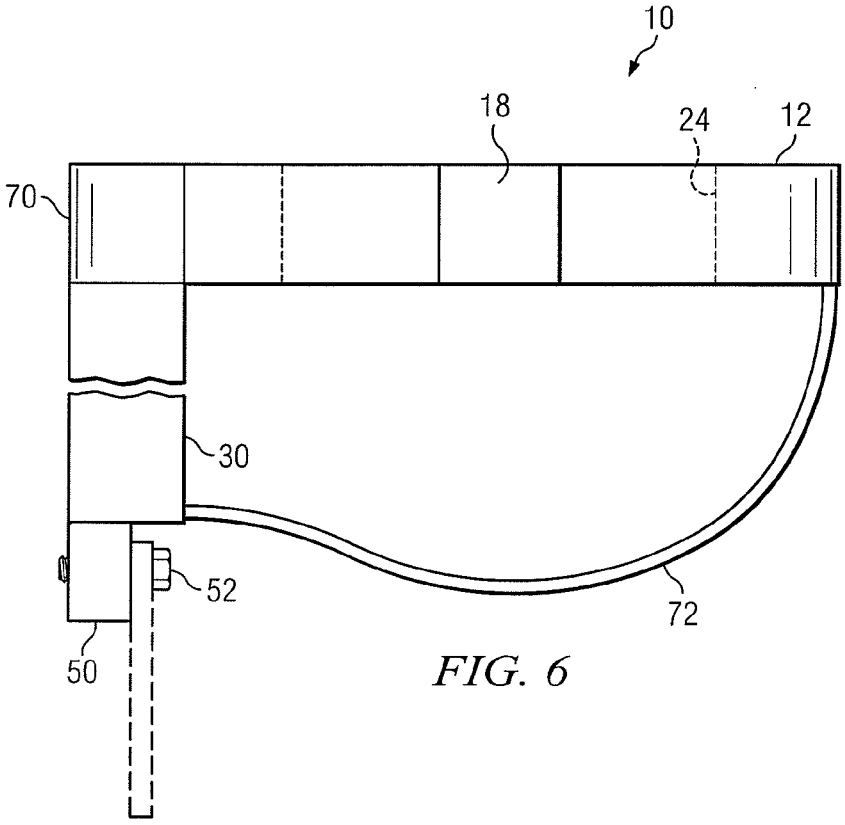

Reference is now made to FIG. 6 which shows a side view of the assembly shown in FIG. 5. Additionally, in the context of a single connecting member 30 implementation, a tie down strap 72 may be used to connect between the lower ring 50 (or connecting member 30) and the upper collar 12 at a position opposite the connecting member. The tie down forms a strap 72 that is drawn across the center of the bit face, runs up a generally opposing junk slot and is tied or fastened to the opposite side of the upper collar 12. In this configuration, the tie down functions to pull on the lower inner surface of the lower ring 50 (and/or the inner surface of the connecting member 30 at the second end 34). The tie down strap 72 may be made of braided copper or steel wire, or any other material that can supply the appropriate amount of tension to hold the lower ring 50 and connecting member 30 tightly in place.

In a preferred embodiment of the assembly 10, like that shown in FIGS. 5 and 6, the single connecting member 30 extends downwardly from a single attachment point in the channel 14 of the upper collar 12. That single connecting member 30 carries an attachment means at the second end of the connecting member (for example, through the use of the lower flange 52) for attachment to an upwardly deployed attachment means at the top of a whipstock. In this embodiment, the preferred shear bolt or other shear component is located at or near the attachment point on the upper collar 12 (although other shear locations could be selected). After setting the position and orientation of the whipstock that is hanging from the bit through the assembly, the application of downward force in the form of weight, or upward force in the form of pull, causes the shear member to break. This allows the drill bit and/or mill drill to be released from the whipstock. Rotation of the bit may then commence to effectuate milling operations. It will be understood that the initial milling operations performed after releasing the whipstock will destroy the connecting member 30 and any remaining part of the shear component. The upper collar 12 may remain intact, and could be reused in fabricating a subsequent assembly.

Figure 7:
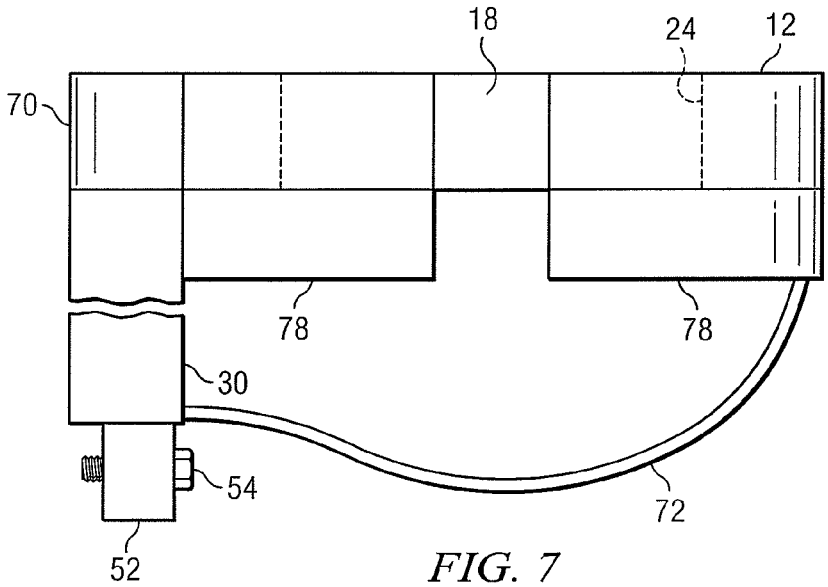
FIGS. 7-9 show modifications of the assembly shown in FIG. 6.

FIG. 7 shows a modification of the assembly shown in FIG. 6 to include a shank shroud 78 which extends downwardly from the upper collar 12. The shank shroud 78 is provided to add further grip and stability to the upper collar assembly.

Figure 8:
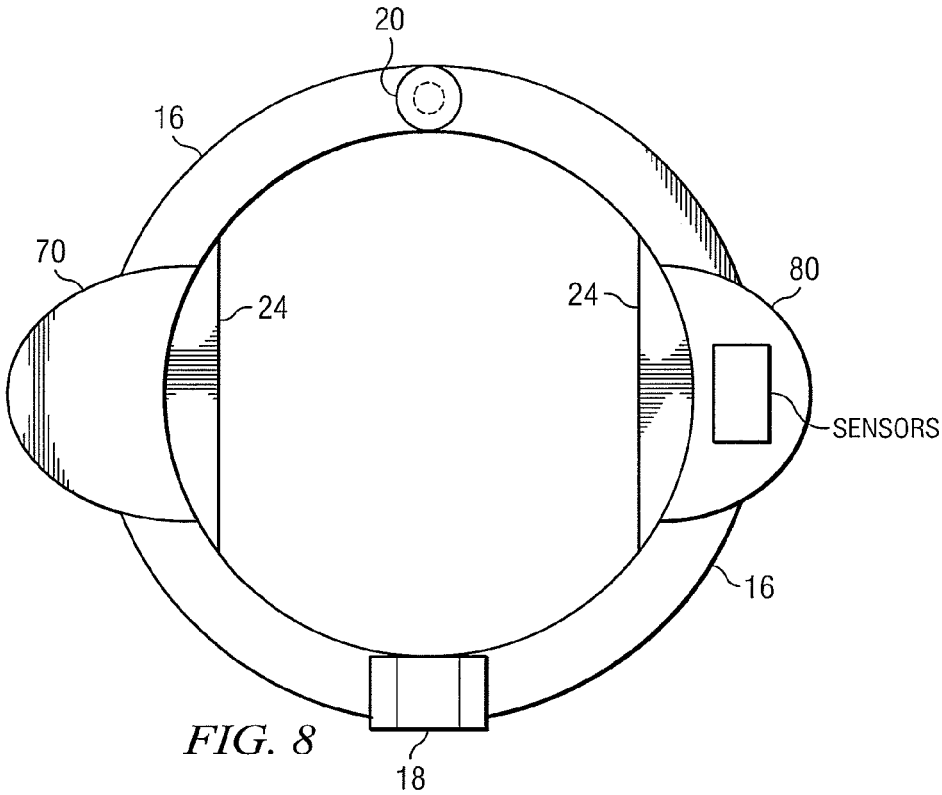
Figure 9:
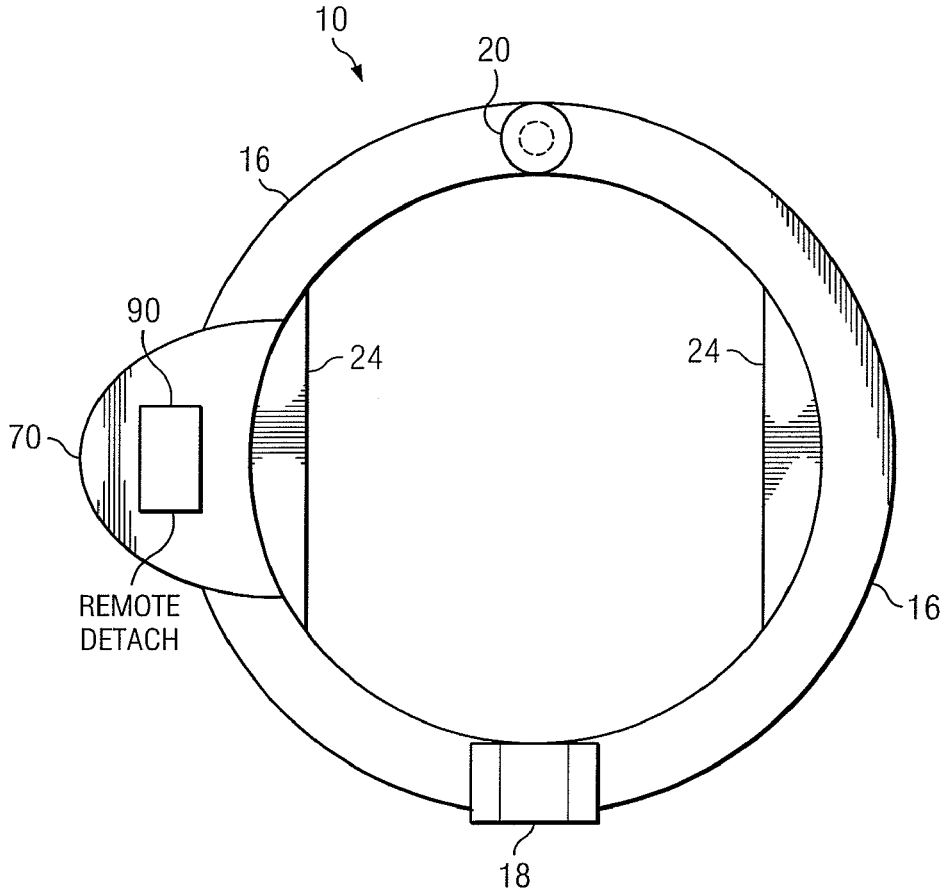

In one specialized embodiment of the apparatus an additional lobe 80 is provided on the upper collar 12 that can be used to deploy sensors capable of communicating information to the lower housing of a mud motor, or capable of recording downhole information. This additional lobe 80 is shown in FIG. 8.

In another specialized embodiment of the apparatus, the lobe 70 which supports the connecting member is provided with an internal detaching mechanism 90 operable to detatch the upper end of a connecting member 30 after the whipstock has been set. An option in this embodiment is to activate the detaching mechanism 90 through the use of a signal sent from the surface via wired drill pipe or a combination of wired bottom hole assembly components and mud pulse signaling. In this embodiment, the mill drill can then be retracted a few feet prior to beginning its milling run in order to immediately mill up the connecting member prior to commencing the rest of the milling task.

As discussed above, the bit may comprise either a mill or a drill bit. There would be an advantage if the bit could perform both milling and drilling function. In a preferred implementation of a system for mill/drill operations comprising the assembly discussed above in combination with a bit, the bit may comprise a PDC drill bit like that shown in FIGS. 4 and 4A, except that the bit includes a unique set of capped PDC cutters as described below.

Figure 10:
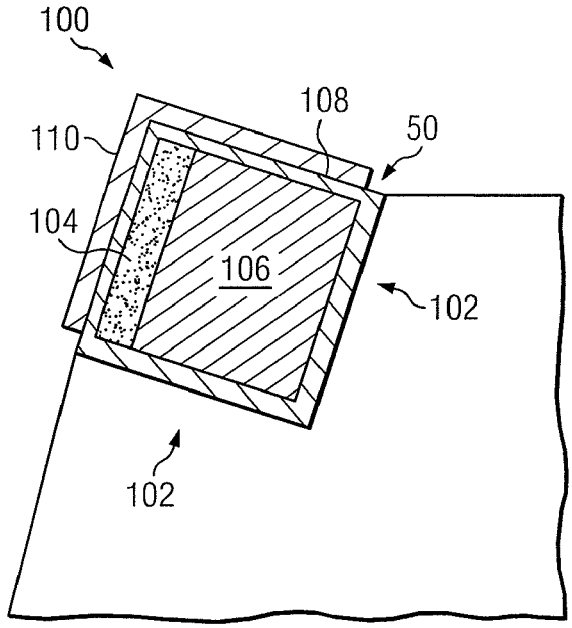
FIG. 10 shows a side view of a PDC cutter.

Reference is now made to FIG. 10 which shows a side view of a PDC cutter 100 installed in a pocket 102 of a drill bit (like that present in FIG. 4). The PDC cutter 100 comprises a diamond table layer 104 (or diamond face) and an underlying substrate 106 which may be made of a tungsten carbide material. The cutter pocket 102 is formed in a bit body which may be made of tungsten carbide in a matrix. The diamond table layer 104 may be non-leached, shallow leached, deep leached, or resubstrated fully leached, as desired. The configuration of PDC cutters and drill bit bodies with pockets is well known to those skilled in the art and will not be described in further detail except as is necessary to understand the present invention.

The PDC cutter 100 is typically secured within the cutter pocket 102 by brazing, although other methods may be used. The braze material 108 used to secure the PDC cutter 100 within the pocket 102 typically has a melting point in a range of 1300 degrees Fahrenheit to 1330 degrees Fahrenheit. The thickness of the braze material illustrated in FIG. 10 is shown over-scale in order to make its location and presence clear.

FIG. 10 further shows a cap 110 which has been installed on the PDC cutter 100. It will be understood that the cap 110 can, in a first implementation, be installed on the PDC cutter 100 after the PDC cutter has been secured to the cutter pocket 102 of the bit body. Alternatively, in a second implementation, the cap 110 is installed on the PDC cutter 100 before securing the combined cutter-cap assembly to the cutter pocket 102 of the bit body. Thus, the first implementation represents, for example, a retrofitting of a manufactured PDC drill bit to include a cap on desired ones of the included PDC cutters. Conversely, the second implementation represents, for example, the fabrication of a new PDC drill bit to include a capped PDC cutter at selected locations.

FIG. 10 specifically illustrates the use of a tungsten carbide cap (i.e., a cap made from tungsten carbide material). The material for the cap 110 may comprise a high toughness, low abrasion resistant tungsten carbide material, for example, a tungsten carbide material containing cobalt percentages in the 14-18% range. The cap 110 may have any desired shape, and several different shapes and configurations are discussed herein. Alternatively, as will be discussed in more detail herein, the cap 110 may alternatively be made of a metal (or metal alloy) material. Still further, that metal/metal alloy cap 110 may include a tungsten carbide or CBN tip. The cap 110 may alternatively be made of another suitable material of choice (non-limiting examples of materials for the cap include: steel, titanium, nickel and molybdenum).

The cap 110 is held in place on the PDC cutter 100 through a bonding action between the cap and the substrate 106 of the PDC cutter. More specifically, a portion of the cap 110 is bonded to a portion of, or a majority of, the substrate 106 of the installed PDC cutter that is exposed outside of the drill bit body (i.e., outside of the cutter pocket 102). The cap 110 is attached to the PDC cutter 100, in one implementation, using brazing to the substrate (a tungsten carbide substrate, for example). The braze material 108 used to secure the cap to at least the substrate of the PDC cutter typically has a melting point of less than 1250 degrees Fahrenheit (and is thus less than the melting point range of 1300 degrees Fahrenheit to 1330 degrees Fahrenheit for the brazing material used to secure the PDC cutter within the cutter pocket). The thickness of the braze material illustrated in FIG. 10 is shown over-scale in order to make its location and presence clear.

Preferably, the cap 110 is not brazed (i.e., is not attached) to the diamond table layer 104 of the PDC cutter 100. Rather, a first portion of the cap 110 over the front face of the diamond table layer 104 of the PDC cutter simply rests adjacent to that face, while a second portion of the cap over the substrate 106 is secured to that substrate by bonding. In this context, it is recognized that PDC diamond is not wetable with standard braze material. It is important that the diamond table face of the PDC cutter be protected by the cap without the cap being directly bonded to the face. The second portion of the cap 110 adjacent the substrate 106 of the PDC cutter 100, which is brazed and attached to the substrate material, may further be attached through brazing to the bit body in an area at the back of the cutter pocket. The first portion of the cap may also be attached through brazing to the cutter pocket (more specifically, the base of the cutter pocket below the face of the PDC cutter). In some embodiments shorter substrate PDC cutters are used to increase the bond area of the cap at the base of the cutter pocket. In some embodiments the pocket base is configured to increase the bonding area available to the cap at the same location.

Some braze material 108 may advantageously be present between the cap 110 and the front face of the diamond table layer 104 of the PDC cutter 100, but this material does not serve to secure the cap to the diamond table layer. In a preferred embodiment, the braze material used to braze the cap to the cutter substrate adheres to the inner surfaces of the cap that are adjacent to the diamond table face and periphery of the PDC diamond layer. This braze material provides a thin cushioning layer to limit the transfer of impact loads to the diamond layer while the caps are in use for milling casing or casing-associated equipment. Once the milling operation is completed, and the drill bit begins formation drilling, the cap (at least over the diamond table face) wears or breaks away so as to allow the diamond table to function as the primary cutting structure. In this way, the drill bit can be first used for milling (with the cap) and then used for drilling (with the diamond table), thus obviating the need to use and then pull a specialized milling bit from the hole.

In an alternative embodiment the cap 110 can be pre-mounted on the PDC cutter 100 using a high temperature braze material 108 in an LS bonder as is known in the art. The pre-capped PDC cutter can then be brazed into the cutter pocket 102 of a drill bit using known brazing methods and temperatures for brazing cutters into bits.

With respect to the shape and configuration of the cap 110, the cap may cover, without directly bonding to, substantially all of the diamond face 104 of the PDC cutter 100. Alternatively, the cap 110 may cover, without directly bonding to, more than 50% of the diamond face 104 of the PDC cutter 100. Alternatively, the cap 11 may cover, without directly bonding to, approximately 50% of the diamond face 104 of the PDC cutter 100. Alternatively, the cap 110 may cover, without directly bonding to, less than 50% of the diamond face 104 of the PDC cutter 100. Examples of different shapes with different covering percentages are shown in FIGS. 11 and 12.

Figure 11:
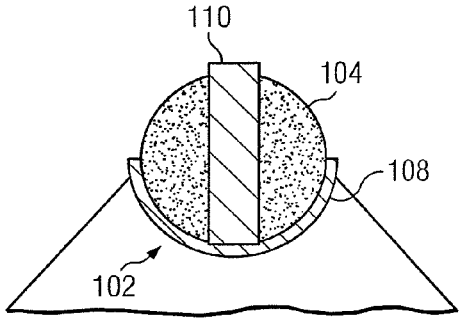
FIGS. 11-14 illustrate different shapes for the portion of a cap used on the PDC cutter.
Figure 12:
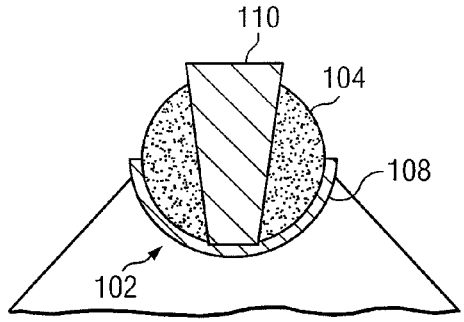

FIG. 11 illustrates a rectangular shape for the portion of the cap 110 which overlies the diamond face 104 of the PDC cutter 100. FIG. 12 illustrates a trapezoidal shape for the portion of the cap 110 which overlies the diamond face 104 of the PDC cutter 100. FIGS. 11 and 12 are end views looking towards the diamond face down the longitudinal axis of the PDC cutter. Again, in FIGS. 11 and 12 the thickness of the braze material for securing the PDC cutter within the cutter pocket has been exaggerated for clarity.

Other geometric shapes may be used to provide more or less or different coverage of the diamond face. See, for example, FIGS. 13 and 14.

Figure 13:
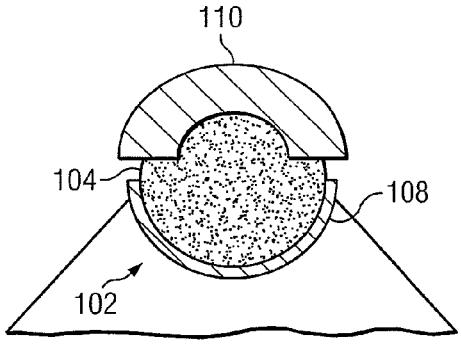
Figure 14:
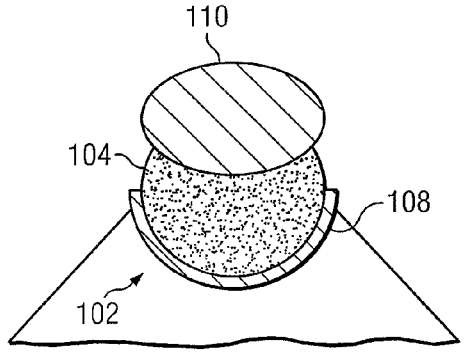

FIG. 13 illustrates a curved segment (eyebrow) shape for the portion of the cap 110 which overlies the diamond face 104 of the PDC cutter 100. FIG. 14 illustrates an oval or elliptical shape for the portion of the cap 110 which overlies the diamond face 104 of the PDC cutter 100. FIGS. 13 and 14 are end views looking towards the diamond face down the longitudinal axis of the PDC cutter. Again, in FIGS. 13 and 14 the thickness of the braze material for securing the PDC cutter within the cutter pocket has been exaggerated for clarity.

Figure 15:
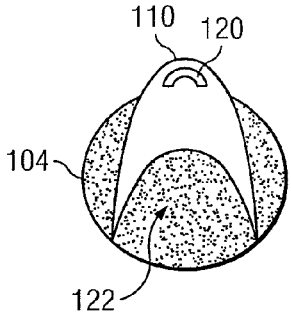
FIGS. 15 and 16 illustrate a chip breaker type groove or depression formed in the front face of the cap.
Figure 16:
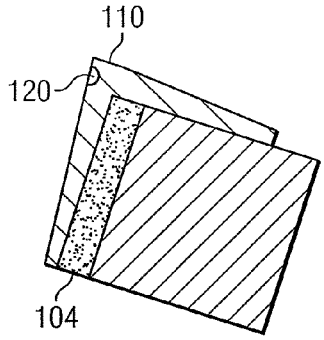

In a preferred embodiment the caps 110 have faces that are inclined to produce a lower back rake angle relative to the milling target than the back rake angle of the underlying PDC cutters 100. This is illustrated in FIGS. 15 and 16, wherein FIG. 15 shows an end view and FIG. 16 shows a side view of the implementation. Although FIG. 15 shows yet another different shape for the cap, it will be recognized that the differently inclined face of the cap (with respect to the diamond table) as shown in FIG. 16 to provide a lower back rake angle is equally applicable to any desired cap shape including those shown above in FIGS. 10-14. The angular difference between the diamond table face and the cap front face may range from a few degrees to ten to twenty degrees.

FIGS. 15 and 16 further illustrate the optional presence of a chip breaker 120 type groove or depression formed in the front face of the cap 110 near the cutting end at its outer tip. This structure may improve performance when milling/machining of casing or casing-associated equipment. In an alternative embodiment, serrations or grooves may be in the configuration of the cap to not only improve milling performance but also create predetermined fracture planes to better allow the caps to disintegrate following the completion of milling operations and the commencement of formation drilling. Such grooves or serrations on the caps also improve cooling and cleaning of the caps during milling operations.

FIG. 15 further shows another shape configuration for the cap 110. In this case, the outer peripheral shape of the cap is a half-ellipse whose major axis is oriented towards the cutting tip. Alternatively, this half-ellipse shape could instead comprise a hemispherical shape. A cut out portion 122 is provided extending in from this half cutoff shape with the cut out portion having generally the same geometric shape as the outer peripheral shape of the cap.

Although not specifically illustrated in the foregoing FIGS. 10-16, it will be understood that the front face of the cap 110 may be formed to include a siderake angle that is different than the siderake of the underlying PDC cutter 100. In other words the thickness of the front face portion of the cap is greater on one side (for example, the outboard side) of the cap than the other side (for example, the inboard side) of the cap. This optional siderake feature is illustrated in FIG. 17 with the dotted line 160.

In a preferred embodiment the caps 110 incorporate holes or slots 130 that improve the flow of braze material to the inner mating faces of the caps when they are being installed. In a preferred embodiment these same holes or slots 130 are configured to accelerate the disintegration and shedding of the caps after the milling is completed and as the caps begin to encounter rock formation. This is illustrated in FIG. 17 which illustrates a side view of a cap 110 incorporating the holes/slots 130.

Figure 17:
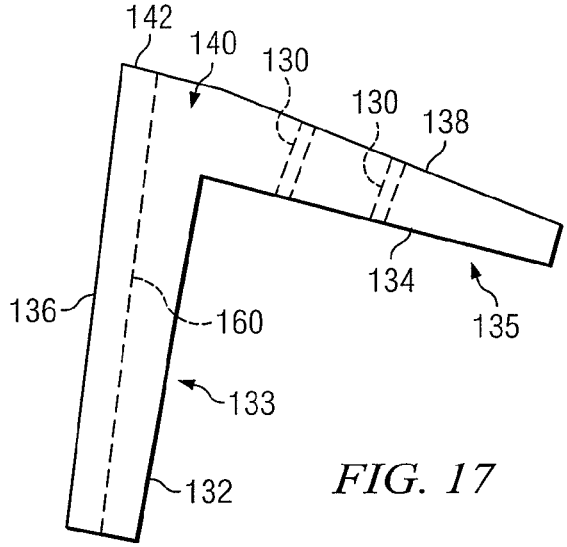
FIG. 17 illustrates an optional siderake feature for the cap.

FIG. 17 provides an enlarged side view of the cap structure. The cap 110 includes two inner surfaces which are set perpendicular to each other. A first of those perpendicular surfaces 132, associated with a first portion 133 of the cap, is positioned adjacent the diamond table face of the PDC cutter (not shown in FIG. 17). A second of those perpendicular surfaces 134, associated with a second portion 135 of the cap, is positioned adjacent the side of the PDC cutter. A front surface 136 of the cap is set at an acute angle with respect to the first perpendicular surface 132 in order to provide for the desired back rake change in comparison to the diamond table face. A side surface 138 of the cap is set at an acute angle with respect to the second perpendicular surface 134. The combination of the angled front and side surfaces 136 and 138 provides for a thickening of the cap towards a tip 140 where the first and second portions 133 and 135 of the cap 110 meet. In an implementation, the front and side surfaces 136 and 138 may meet at the tip 140 of the cap 110. Alternatively, as shown in FIG. 17, an additional surface 142, which is generally parallel to the second perpendicular surface 134, connects the angled front and side surfaces 136 and 138 at the tip portion of the cap. The cap is an integrally formed article comprising the first and second portions interconnected at the tip portion.

In a preferred embodiment the outer tip 140 of the cap is circumferentially forward of the outer tip of the PDC cutter it is protecting even when cutter back rake is taken into account. If a line normal to the bit profile is drawn through the cutting tip of the PDC and a line normal to the bit profile is drawn through the outer tip of the corresponding cutter cap then in this embodiment the lines are substantially parallel and the line through the outer tip of the cutter cap is offset from the line through the PDC cutter tip by a radial distance of at least 0.030". Also, in a preferred embodiment the outer tip of the cap is offset, in a direction normal to the diamond table face, from the cutter tip of the PDC cutter by a forward distance of at least 0.030".

Embodiments discussed above emphasize the use of tungsten carbide material for the cap. In an alternative embodiment, the caps are instead made primarily of steel (or nickel or titanium, or any other appropriate metal or alloy). Some milling operations are better performed with a metal, as opposed to a tungsten carbide, cap. Such a cap could have the shape and configuration as shown in FIG. 17.

Figure 18:
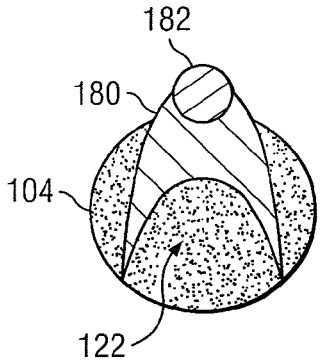
FIGS. 18 and 19 show an end view and a side view, respectively, of an alternative implementation for the cap.
Figure 19:
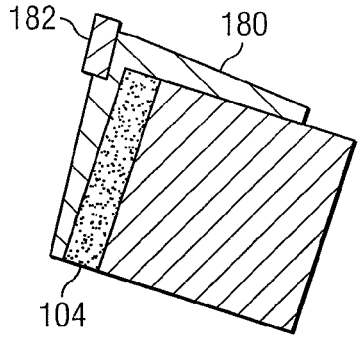

In an alternative embodiment, a cap 180 made of the metal/metal alloy material may additionally be set with a tungsten carbide or CBN outer tip 182. This implementation is illustrated in FIGS. 18 and 19, wherein FIG. 18 shows an end view and FIG. 19 shows a side view of the implementation. Such a tungsten carbide or CBN outer tip 182 may be brazed to the metal base cap 180 in the tip portion, or mounted thereto with a fastener (such as a screw secured through use of a tapped hole on the face of the metal base cap). Alternatively, the tungsten carbide or CBN outer tip 182 may be hot pressed, high pressure pressed, LS bonded or otherwise adhered to the base cap 180 material in the tip portion. In the embodiments where the outer tip is brazed or LS bonded to the metal base cap a high temperature braze material with a melting point above the melting point of the braze material to be used to mount the PDC cutters in the bit is recommended.

The cap configuration of FIGS. 18 and 19 may have the same forward and radial offsets as discussed above with respect to FIG. 17.

Figure 20:
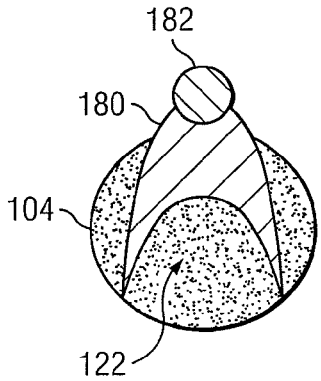
FIGS. 20 and 21 show an end view and a side view, respectively, of an alternative implementation for the cap.
Figure 21:
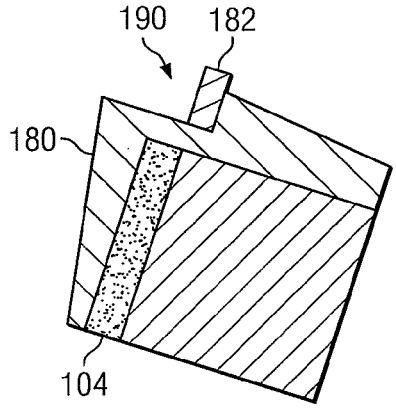

Reference is now made to FIGS. 20 and 21. In yet another embodiment the front face of the cap is offset from the diamond table face (for example, by a distance of 0.030") but the outermost tip of the cap is either radially aligned with the PDC tip or is offset rearwardly from the PDC tip (i.e., it falls some distance behind the cutting tip of the corresponding PDC cutter as indicated at reference 190). In either of these instances, the difference in the location of the outer tip of the cap from the front face of the tip is accomplished through the use of an intervening bevel, ramp, arc, or step. In all instances the outer tip of the cap is in relatively close proximity to the cutting tip of the corresponding PDC cutter than in any of the non-bonded standalone or augmented substrate cutting structures of the prior art. This is advantageous in that when a bit is retrofitted with the caps the underlying force balance attributes of the bit are minimally affected. During milling or drill out the bit will benefit from the underlying force balanced layout. Another perceived advantage of this layout is that the effectiveness of the tip for milling purposes may be enhanced by falling slightly behind the PDC cutter tip. The outer cap tip will be better positioned to shear away metal surfaces than plow metal surfaces making for more efficient machining.

In some embodiments, the caps 110 may be deployed on upreaming or backreaming sections of the drill bit to enhance the ability of the bit to mill back through milling debris, whipstock attachment equipment, or pull back through a casing window or drilled casing-associated equipment.

It will be recognized that existing bits or bit designs can be readily retrofitted to accept the caps 110. The caps are robust enough to accomplish the milling tasks asked of them while being structurally predisposed to accelerated disintegration and shedding when milling is completed and the bit moved forward for drilling the formation. Bits retrofitted with the caps can be used to drill out steel bodied casing shoe bits or casing shoe bits constructed from other materials extending the casing shoe bit choices of casing drilling operations. Bits of the current invention can also be used in one trip mill drill systems where the bit is attached at the top of a whipstock for running in the hole.

The PDC drill bit including caps as described herein can be advantageously used in combined milling and formation drilling operations, such as when used in combination with the whipstock attachment assembly described herein. In accordance therewith, a PDC cutter drill bit having a plurality a PDC cutters with certain ones of the cutters including a milling cap attached to the PDC cutter is provided for attachment to a drill string or other drilling equipment and the whipstock is hung from the bit using the disclosed assembly. The milling cap is configured for milling operations on a casing-associated component located in the hole but is not optimal for earth formation drilling operations. After the whipstock is placed in the borehole, and then released through the shearing operation described above, the drill bit is rotated and the milling cap on the drill bit used to perform a down hole milling operation on the casing-associated component with the assistance of the whipstock. Drilling with the drill bit continues after milling of the casing-associated component to drill the earth formation outside the casing window. Importantly, the same drill bit is being used, and thus there is no need to pull a milling bit from the hole before resuming formation drilling. The drilling of the earth formation causes the milling caps on the drill bit to be destroyed and thus reveal the diamond table surface of the PDC cutter which are then used in engaging the earth formation.

Embodiments of the invention have been described and illustrated above. The invention is not limited to the disclosed embodiments.

What is claimed is:

1. Apparatus configured for non-invasive attachment of a whipstock to a mill/drill bit, said mill/drill bit including a shank portion, a plurality of cutting blades extending below the shank portion to define an outer gage of the mill/drill bit and cutting face of the mill/drill bit, and at least one junkslot between two of the plurality of cutting blades, comprising:

an upper collar adapted for installation around the shank of the mill/drill bit;

at least one connecting member mounted at a first end to the upper collar above the cutting blades and extending downwardly therefrom, the connecting member extending through the junkslot of the mill/drill bit, the connecting member having a length which is long enough to extend to a second end below the cutting face of the mill/drill bit; and a whipstock attachment structure mounted to the second end of the at least one connecting member.

2. The apparatus of claim 1 wherein the whipstock attachment structure comprises a flange member supporting an attachment mechanism adapted to attach the flange to a top of a whipstock.

3. The apparatus of claim 1 wherein the upper collar includes a channel, and the first end of the at least one connecting member is mounted within the channel.

4. The apparatus of claim 1 further including a lobe member extending outwardly from the upper collar, the first end of the at least one connecting member being mounted to the lobe member.

5. The apparatus of claim 4 further including a remotely actuated detachment mechanism in the lobe member, the detachment mechanism being remotely controlled to cause the first end of the at least one connecting member to become detached from its mounting to the lobe member.

6. The apparatus of claim 1 wherein the whipstock attachment structure comprises:

a lower ring segment coupled to each of the plural connecting members at the second ends; and a whipstock attachment flange extending downwardly from the lower ring segment.

7. The apparatus of claim 1 further including a lobe member extending outwardly from the upper collar, the lobe member including a downhole sensor.

8. The apparatus of claim 1 wherein the at least one connecting member comprises a plurality of members connected at their first ends to the upper collar and extending downwardly therefrom to extend through corresponding junkslots of the mill/drill bit.

9. The apparatus of claim 8 further including a mid-ring coupled to each of the plural connecting members between the first and second ends.

10. The apparatus of claim 8 wherein the whipstock attachment structure comprises:

a lower ring segment coupled to each of the plural connecting members at the second ends; and a whipstock attachment flange extending downwardly from the lower ring segment.

11. The apparatus of claim 1 wherein the at least one connecting member is mounted to the upper collar at a first side of the upper collar, further comprising a tie down strap having a first end connected to the upper collar at a second side opposite the first side, a second end of the tie down strap being connected to either the second end of the connecting member or the whipstock attachment structure.

12. The apparatus of claim 1, wherein the shank of the mill/drill bit includes a breaker slot, and wherein the upper collar includes at least one breaker slot insert adapted to engage the breaker slot so as to preclude rotation of the upper collar about the shank of the mill/drill bit.

13. The apparatus of claim 1 wherein the upper collar comprises a first arcuate member hinged to a second arcuate member and including a latching mechanism for latching the first and second arcuate members together.

14. The apparatus of claim 1 further including a shank shroud extending downwardly from the upper collar.

15. A method for non-invasively hanging a whipstock on a mill/drill bit, the mill/drill bit including a shank portion, a plurality of cutting blades extending below the shank portion to define an outer gage of the mill/drill bit and cutting face of the mill/drill bit, and at least one junkslot between two of the plurality of cutting blades, the method comprising:

attaching an upper collar around the shank of the mill/drill bit; and hanging the whipstock from a connecting member mounted at a first end to the upper collar and extending downwardly therefrom, the connecting member extending through the junkslot of the mill/drill bit, the connecting member having a length which is long enough to extend to a second end below the cutting face of the mill/drill bit.

16. The method of claim 15, wherein the shank of the mill/drill bit includes a breaker slot, and wherein attaching the upper collar comprises coupling the upper collar to the breaker slot in a manner which precludes rotation of the upper collar about the shank of the mill/drill bit.

17. The method of claim 16 further comprising configuring a shearing member.

18. A system, comprising:

a drill bit including:

a shank portion;

a bit body below the shank portion and including a plurality of cutting blades defining an outer gage of the drill bit, each cutting blade including a plurality of cutter pockets;

a PDC cutter including a diamond table layer and an underlying substrate layer installed in each cutter pocket to define a cutting face of the drill bit; and a whipstock hanger assembly configured to support non-invasive attachment of a whipstock to the drill bit, comprising:

an upper collar adapted for installation around the shank portion;

at least one connecting member mounted at a first end to the upper collar above the cutting blades and extending downwardly therefrom, the connecting member extending through a junkslot of the drill bit between two of the cutting blades, the connecting member having a length which is long enough to extend to a second end below the cutting face of the drill bit; and a whipstock attachment structure mounted to the second end of the at least one connecting member.

19. The system of claim 18 further comprising the whipstock, the whipstock having a top end, the top end of the whipstock being attached to the whipstock attachment structure.

20. The system of claim 18 wherein certain ones of the PDC cutters include a cap structure on a front face of the diamond table layer that is made of a tungsten carbide material.

21. The system of claim 18 wherein certain ones of the PDC cutters include a cap structure on a front face of the diamond table layer that is made of a metal/metal alloy material.

22. The system of claim 21 wherein the cap structure further includes a tungsten carbide outer tip mounted to the metal/metal alloy cap material.

23. The system of claim 21 wherein the cap structure further includes a CBN outer tip mounted to the metal/metal alloy cap material.

24. The system of claim 18 wherein certain ones of the PDC cutters include a cap structure on a front face of the diamond table layer, further including an outer tip made of a material different from the material from which a majority of the cap structure is formed.

25. The system of claim 24 wherein the outer tip of the different material is offset rearwardly from a front face of the first portion of the cap structure.

26. The system of claim 25 wherein the offset places the outer tip of the different material behind the front face of the diamond table layer.

27. The system of claim 24 wherein the outer tip of the different material is aligned in same plane with a front face of the first portion of the cap structure.

28. The system of claim 18 where the PDC cutter is mounted to the cutter pocket with a brazing material, the PDC cutter further including a cap structure positioned over a front face of the diamond table layer with an intervening cushioning layer of the brazing material.

29. The system of claim 18 wherein certain ones of the PDC cutters include a cap structure further including a structural feature which accelerates disintegration and shedding of at least a not attached first portion of the cap structure.

30. The system of claim 18, wherein the shank of the drill bit includes a breaker slot, and wherein the upper collar includes at least one breaker slot insert adapted to engage the breaker slot so as to preclude rotation of the upper collar about the shank of the drill bit.

* * * * *